US005415119A

United States Patent [19]

Ikeda

[11] Patent Number: 5,415,119

[45] Date of Patent: May 16, 1995

[54] UNDER TRIMMING DEVICE FOR A MULTI-NEEDLE SEWING MACHINE

[75] Inventor: Kenji Ikeda, Tao-Yuan, China

[73] Assignee: Kaulin Mfg. Co., Ltd., Taipei, Taiwan, Prov. of China

[21] Appl. No.: 123,326

[22] Filed: Sep. 17, 1993

[51] Int. Cl.[6] ..... D05B 65/00

[52] U.S. Cl. ..... 112/296; 112/163; 112/DIG. 1

[58] Field of Search ..... 112/296, 285, 287, 253, 112/DIG. 1, 163, 164, 165, 166, 167

[56] References Cited

U.S. PATENT DOCUMENTS 3,405,672 10/1968 Ross ..... 112/296
5,156,103 10/1992 Buschmann et al. .... 112/DIG. 1 X
5,178,084 1/1993 Rohr ..... 112/163 X

FOREIGN PATENT DOCUMENTS 75288507 9/1975 Taiwan, Prov. of China .

OTHER PUBLICATIONS

English translation of Abstract of Taiwan Utility Model Application No. 75288507.

*Primary Examiner*—Peter Nerbun
*Attorney, Agent, or Firm*—Woodard, Emhardt, Naughton, Moriarty & McNett

[57] ABSTRACT

The present invention relates to an under trimming device mounted below a needle late of a multi-needle sewing machine which mainly comprises an under trimming subassembly and a thread-sucking subassembly. The under trimming subassembly comprises a linkage and a thread-releasing means both being capable of shifting the under trimming subassembly into a standby position, extended position, thread-catching position, retracted and cut position, thread-clamping position, and a thread-releasing position in a series of linear movements. The thread-sucking subassembly is provided at one lateral side of the under trimming subassembly such that the looper thread cut and released by the under trimming subassembly can be instantly sucked and clamped in place and then used in the next sewing operation.

1 Claim, 8 Drawing Sheets

UNDER TRIMMING DEVICE FOR A MULTI-NEEDLE SEWING MACHINE

BACKGROUND OF THE INVENTION

The present invention relates to an under trimming device for a multi-needle sewing machine, and more particularly to an under trimming device which effectively prevents parts of the under trimming device from solliding and/or interfering with the looper, which moves horizontally in the sewing operation, of the sewing machine while it enables the thread used in sewing to be temporarily sucked and clamped after the thread was cut and then be used in the next sewing Operation.

Multi-needle sewing machines are now widely used in private homes and factories. A multi-needle sewing machine of this kind generally has multiple sewing needles above a needle plate of the sewing machine to carry multiple needle threads while there is only one looper under the needle plate to carry a single looper thread. Since the sewing principle and needle movement of a sewing machine are not the subject of the present invention, they are not discussed herein. What the present invention wants to discuss is an under trimming means of the conventional multi-needle sewing machine used to cue the thread after the completion of one sewing operation wherein the cut looper thread has to be caught so that the next sewing operation can be started. Taiwanese Utility Model Application No. 75288507 entitled "An Under Trimming Device for A Cylindrical Sewing Machine" discloses an under trimming device for a multi-needle sewing machine. As shown in FIGS. 1 to 5 and 9 of the Taiwanese Utility Model Application No. 75288507, a linkage 30 is utilized to pull a cutting means 2 of the under trimming device so that the cutting means 2 moves in a direction shown in FIG. 9 to catch, cut, and clamp a looper thread 61, as shown in FIGS. 4 and 5. After the completion of one sewing operation, the looper thread 6 is then clamped between a plate 35 and a catcher 13 to facilitate the next sewing operation. There are at least two drawbacks in the Taiwanese Utility Model Application No. 75288507;

1. The catcher 3 swings in a curve Crack and is therefore easily collides with the looper and hence is damaged.
2. The catcher 13 can not be too far away from the needle place to ensure the looper thread to be clamped securely. Besides, if the catcher 13 is too far away from the needle place, the free end of the looper thread after being cut will be too long for the next sewing operation. Instead, the catcher 13 has to be close enough to the needle plate without interfering the looper. The applicant developed an under trimming device for a multi-needle sewing machine to eliminate the drawbacks that exist in the conventional multi-needle sewing machine.

SUMMARY OF THE INVENTION

The under trimming device of the present invention mainly comprises an under trimming subassembly and a thread-sucking subassembly. The under trimming subassembly is mounted below a needle place of the multi-needle sewing machine and comprises a linkage and a thread-releasing means both being capable of shafting the under trimming subassembly into a standby position, extended position, thread-catching position, retracted and cut position, thread-clamping position, and a thread-releasing position in a series of continuous linear movements. The thread-sucking subassembly is provided at one lateral side of the under trimming subassembly such that the looper thread cut and released by the under trimming subassembly can be instantly sucked and clamped in place by the thread-sucking subassembly and then used in the next sewing operation. Since the thread-sucking subassembly ensures that the cut looper thread will be sucked in place, the under trimming subassembly can therefore be mounted far away from the sewing needles and looper of the multi-needle sewing machine to prevent parts of the under trimming device from colliding and interfering with the sewing needles and looper of the sewing machine, and thereby the life of the sewing machine can be extended.

It is therefore an object of the resent invention to provide an under trimming device for a multi-needle sewing machine which effectively prevents the under trimming device from colliding and/or interfering with the sewing needles and the looper of the sewing machine.

It is also an object of the present invention to provide an under trimming device for a multi-needle sewing machine wherein the cut looper thread can be securely sucked and clamped in place and then used in the next sewing operation.

It is further an object of the present invention to provide an under trimming device for a multi-needle sewing machine wherein the under trimming subassembly is mounted far away from the sewing needles and looper yet the free end of the looper thread after being cut is quite short.

It is further an object of the present invention to provide an under trimming device for a multi-needle sewing machine which is easy to be manufactured and disassembled.

BRIEF DESCRIPTION OF THE DRAWINGS

The other objects and features of the present invention can be best understood by referring to the following detailed description of the referred embodiment and the accompanying drawings, wherein.

DETAILED DESCRIPTION OF THE PREFERRED EMBODIMENTS

Figure 1:
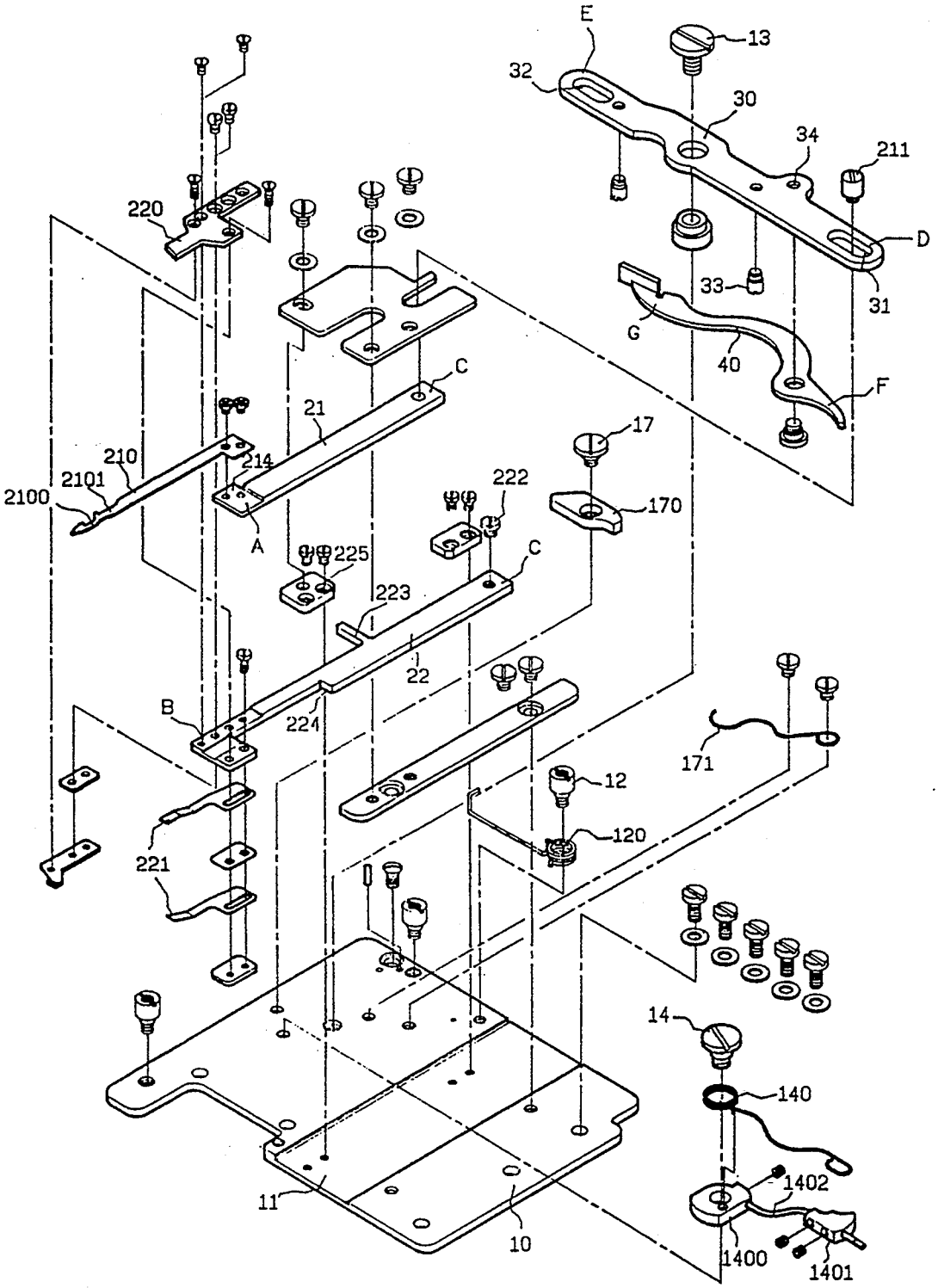
FIG. 1 is the exploded view of the under trimming subassembly according to the present invention.
Figure 2:
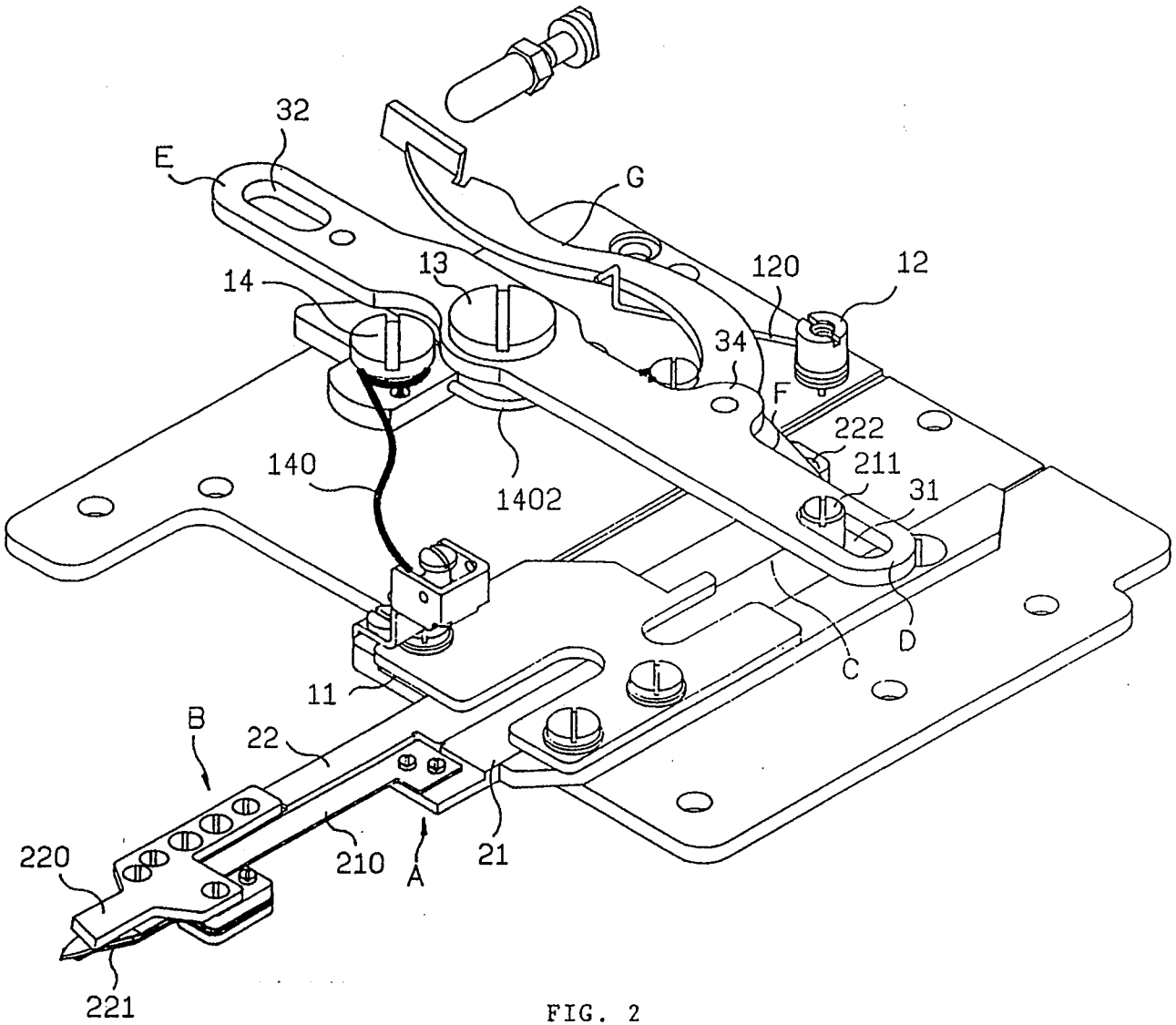
FIG. 2 is the perspective view of the under trimming subassembly according to FIG. 1.
Figure 3:
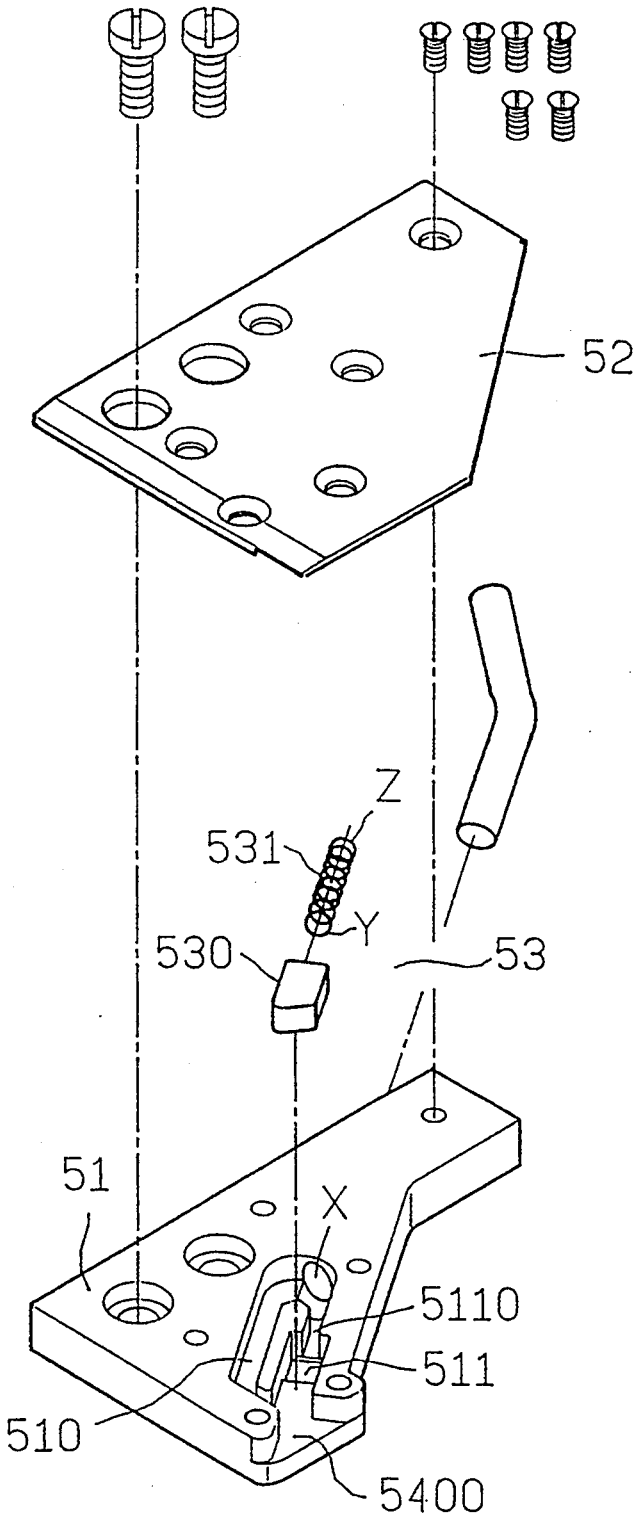
FIG. 3 is the exploded view of the thread-sucking subassembly according to the present invention.

Please first refer to FIGS. 1 to 3, in which a preferred embodiment of the present invention is shown. The present invention is located below a needle plate of a multi-needle sewing machine end comprises an under trimming subassembly 20 and a thread-sucking subassembly 50. The under trimming subassembly 20 is mounted on a base plate 10 and further comprises a linkage 30 and a thread-releasing means 40.

The base plate 10 is formed with a recess 11 and has fastening means 12, 13, 14, and 17 separately arranged thereon. A return spring 120 is provided between the fastening means 12 and the base plate 10. A return spring 140 is provided between the fastening means 14 and the spring base 1400 and then fastened on the base plate 10. The spring base 1400 further includes a return spring 1402 and a spring seat 1401. A regulating base 170 is provided between the fastening means 17 and the base plate 10 and can be controlled by the return spring 171.

The under trimming subassembly 20 comprises a lower knife sliding seat 21 and a upper knife sliding seat 22. The lower knife sliding seat has an end portion A to which a lower knife 210 is connected. The lower knife 210 mainly includes a first hook section 2100 and a second hook section 2101. The upper knife sliding seat 22 has an end portion B to the top of which a upper knife 20 is connected and to the bottom of which the clamping pieces 221 are provided. The lower and the upper knife sliding seats 21, 22 are disposed parallelly in the recess 11 of the base plate 10 such that their other end portions C lie on the recess 11 side by side, and =he lower knife 210 is located right between the upper knife 220 and the clamping pieces 221. Fastening means 211, 222 are respectively connected to the end portions C of the first and the second sliding seats 21, 22. The upper knife sliding seat 22 is formed with a lateral projection 223 near is middle portion, against which the return spring 140 presses so that the upper knife sliding seat 22 and the upper knife 220 connected thereto always return to their original position after they are shifted. A stopper 225 is provided on the base plate 10 for positioning lateral projection 223.

The linkage 30 is substantially an elongated plate being fitted over the base plate 10 by the fastening means 13 such that the linkage 30 is capable of swinging about the fastening means 13 which functions as a pivot. An end portion D of the linkage 30 is formed with an elongated slot 31 to just receive the fastening means 211 connected to the end portion C of the lower knife sliding seat 31 and allow the fastening means 211 to project therefrom. Another end portion E of the linkage 30 is also formed with an elongated slot 32 to connect a transmission mechanism (not shown) of the sewing machine so that the linkage 30 can be driven by the transmission mechanism. The linkage 30 further has a lateral middle projection with a through hole 34 formed therein and a fastening means 33 provided near The thread-releasing means 40 is substantially an elongated S-shaped plate pivotally connected to the linkage 30 at the through hole 34 such that the thread-releasing means 40 is capable of pivotly swinging about the through hole 34. An end portion G of the thread-releasing means 40 is pressed against by the return spring 120 connected to the fastening means 12 on the base plate 10 such that the thread-releasing means 40 always returns to its original position after being shifted. Another end portion F of the thread-releasing means 40 just locates within the shifting track of the fastening means 222 connected to and upwardly projected from the end portion C of the second sliding seat 22 and is therefore, capable of pushing the upper knife sliding seat 22 to move in a direction opposite to the end portion B of the upper knife sliding seat 22.

The thread-sucking subassembly 50 comprises a bottom plate 51 and a top plate 52 covered on the bottom plate 51. The bottom plate 51 has formed at an upper surface thereof two air passages 510, 511 which are communicable a=one end, The air passages 510, 511 have a common air port X to it a suction unit (not shown) is connected. In the air passage 511, a spring holder 53 is disposed. The spring holder 53 consists of a slider 530 and a spring $31. The spring 531 has one end Y pressing against an end wall of the slider 530 and another end Z pressing against a neck portion 5110 of the air passage 511 having a reduced inner diameter and near the air port X.

Figure 4A:
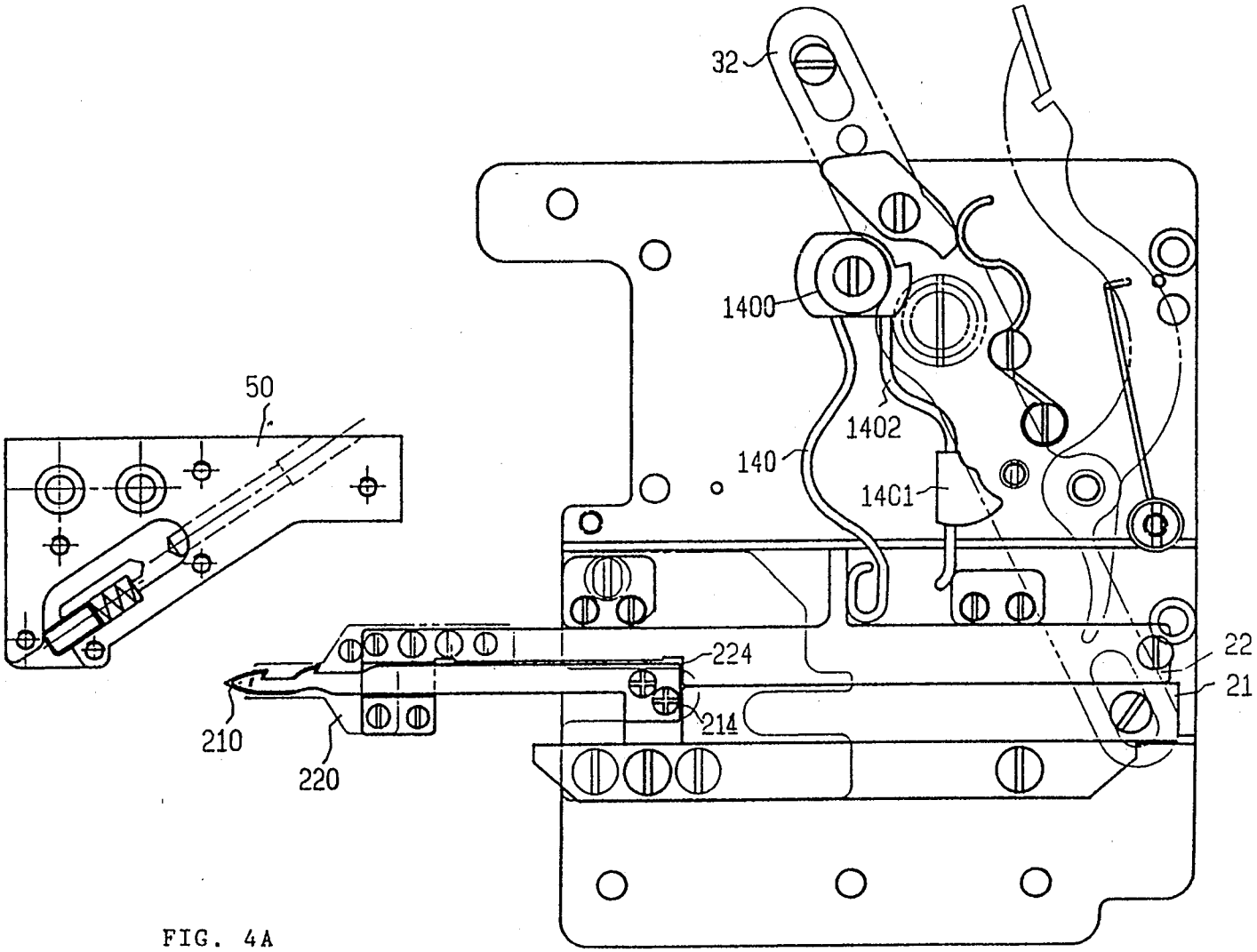
FIG. 4A illustrate the under trimming device according to the present invention wherein the under trimming subassembly is in the standby position.

Please now refer to FIG. 4A. The linkage 30 is driven backwardly by the transmission mechanism such that the lower knife sliding seat 21 is retracted, yet the upper Knife sliding seat 22 is extended due to the force of return springs 140 and 1402 so that convex corner 214 and concave corner 224 are tightly matched.

Figure 4B:
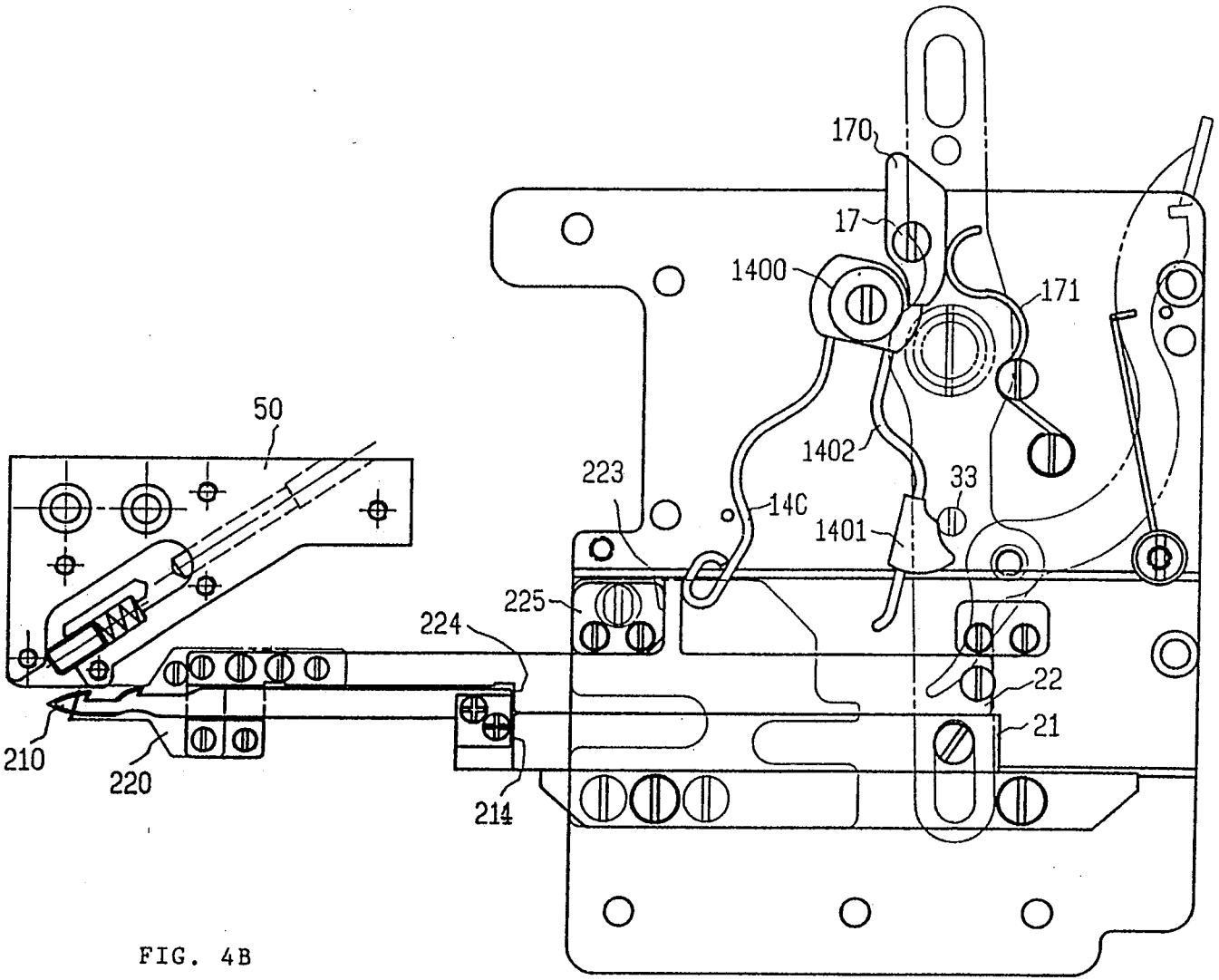
FIG. 4B illustrate the under trimming device according to the present invention wherein the under trimming subassembly is in the extended position.

As shown in FIG. 4B, the linkage 30 is driven forwardly by the transmission mechanism such that the lower knife sliding seat 21 is extended and the upper knife sliding seat 22 is also extended due to the release of return springs 140 and 1402. In the meantime, fastening means 33 provided on the linkage 30 presses spring seat 1401 and accordingly pivotly rotates spring base 1400 enabling the return springs 140 and 1402 to have enough power to push =he upper knife sliding seat 2 until the lateral projection 223 matches with stopper 225. Also, regulating base 170 is pressed by return spring 171 and thus regulates spring base 1400 in is position.

Figure 4C:
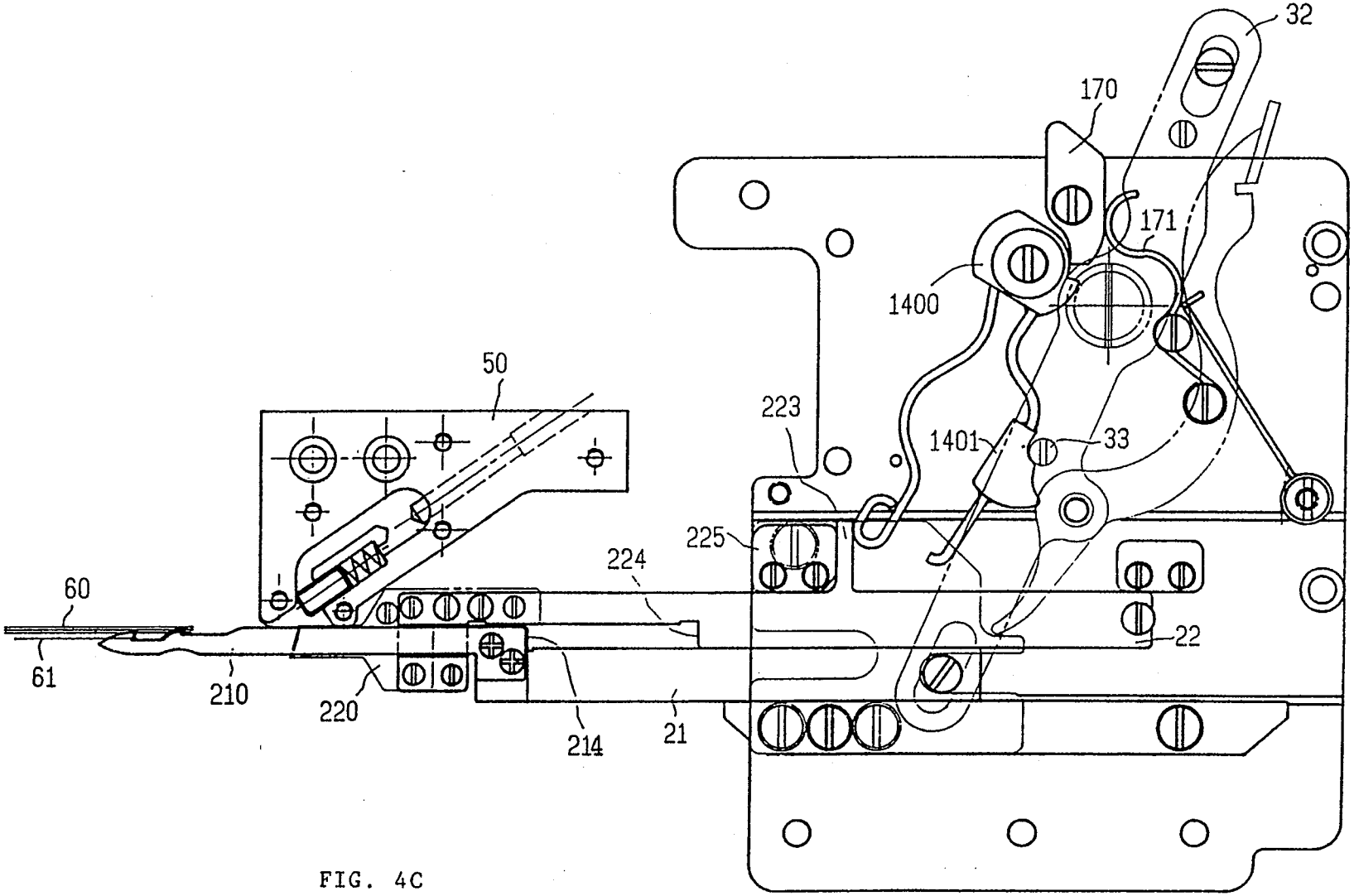
FIG. 4C illustrate the under trimming device according to the present invention wherein the under trimming subassembly is in the thread-catching position.

As shown in FIG. 4C, the linkage 30 is further driven forwardly by the transmission mechanism such that the lower knife sliding seat 21 is extended to is left dead point so that the first hook section 1100 and the second hook section 2101 can Catch the looper thread 61 and the needle thread 60, respectively. Thereafter, the linkage 30 is driven backwardly by the transmission mechanism such that the lower knife 210 is retracted and then the needle thread 60 and the looper thread 61 will be cut subsequently.

Figure 4D:
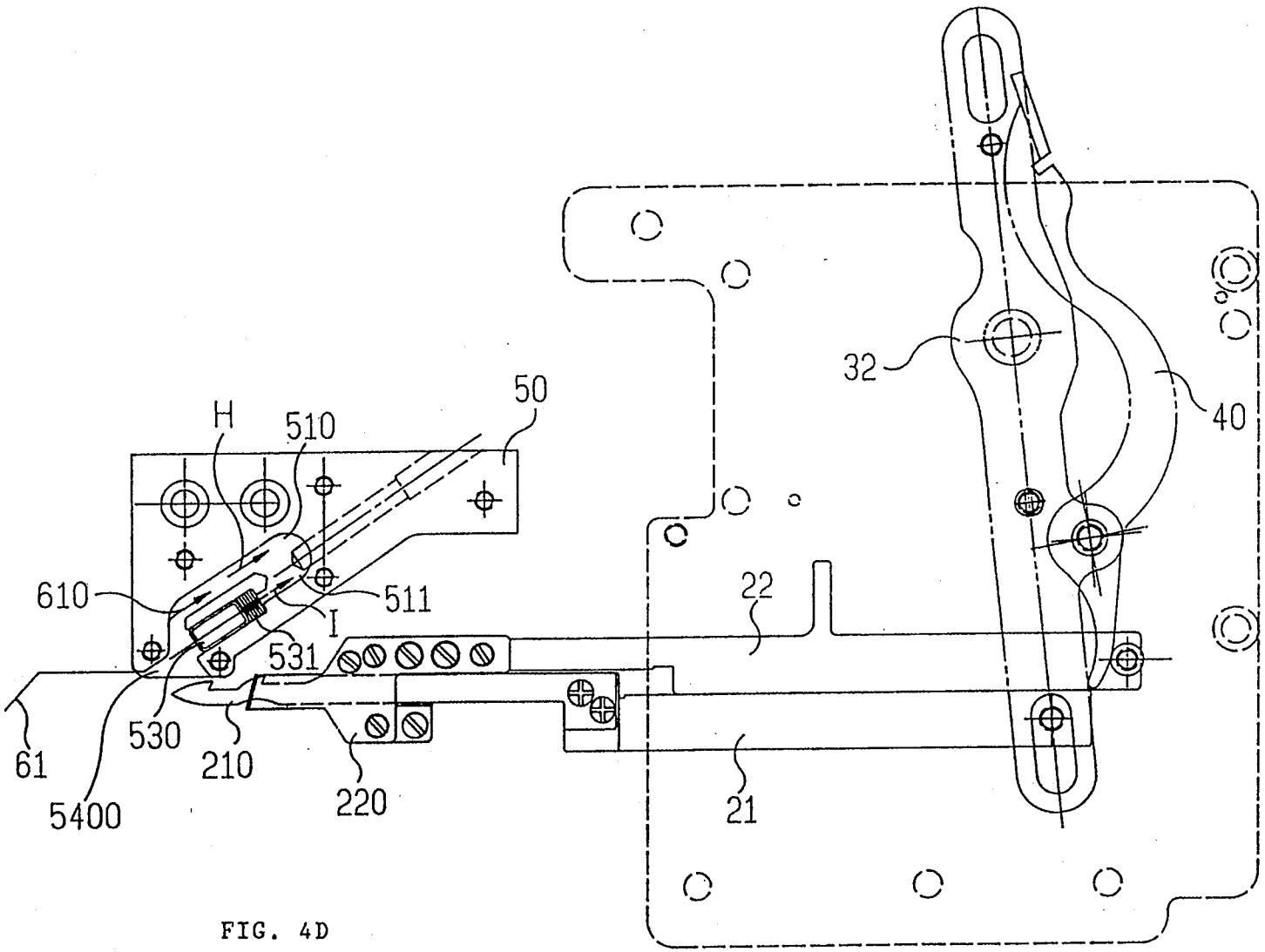
FIG. 4D illustrate the under trimming device according to the present invention wherein the under trimming subassembly is in the thread-releasing position and the thread-sucking subassembly is in the thread-sucking position.

As shown in FIG. 4D, the needle thread 60 is firstly cut by the lower knife 210 and the upper knife 220. Next, the looper thread 61 is cut by the lower knife 210 and the upper knife 220, and at the same time the free end 610 of the looper thread 61 is clamped between the lower knife 210 and the clamping pieces 221. While the lower knife 210 is still retracting, the thread-releasing means 40 is actuated by a power mechanism (not shown) when the first hook section 2100 is close to slider 530 to drive the upper knife 220 moving backwardly and relatively quick when compared to the retracting speed of the lower knife 210, thereby the free end 610 of the looper thread 61 clamped between the lower knife 210 and the clamping pieces 221 is released. At this point, the suction unit (not shown) starts to suck, causing the slider 530 to move along the air passage 511 in a direction as shown by the arrow I and hence the free end 610 of the looper thread 61 is sucked into the air passage 510 in a direction as shown by the arrow H.

Figure 4E:
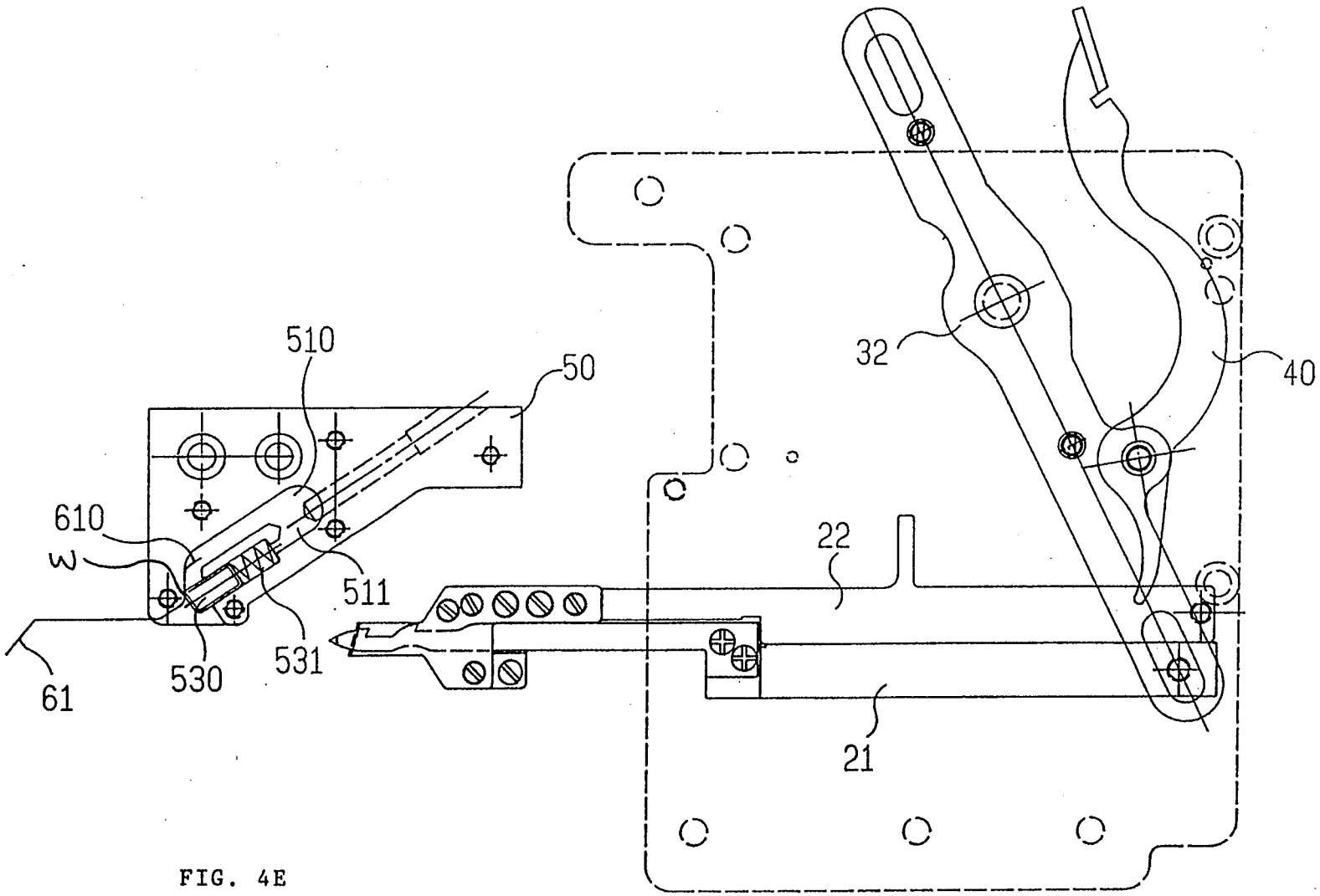
FIG. 4E illustrate the under trimming device according to the present invention wherein the under trimming subassembly is in the standby position and the thread-sucking subassembly is in the thread-clamping position.

As shown in FIG. 4E, when the suction unit shuts off after a short period of time, the slider 530 is pushed back by the return spring 531 to its original position away from the reduced neck portion 5110 in the air passage 511, causing the free end 610 of the looper thread 61 to be clamped between the slider 530 and the air passage 510 at a point W near the inlet peripheral wall of the air passage 10. Meanwhile, the lower knife sliding seat 21 and the upper knife sliding seat 22 are moved back to the standby position such that An the next sewing operation, the looper thread 61 can be successfully knotted onto the work piece to be sewed.

Also, please note that before Cutting the needle threads 60 and the looper thread 61, the under trimming subassembly 20 is far away from the sewing needles and the looper, and when starting to cut the needle threads 60 and the looper thread 61, the sewing needles are moved to the upper dead point and the looper is moved to the left dead point and 11 the needle threads 60 and looper thread 61 are released, then the under trimming device is actuated by moving the lower knife sliding seat 31 and the upper knife sliding seat 22 to a first position and then the lower knife sliding seat 21 is moved to a second position to catch the needle threads 60 and the looper thread 61 and retracted such that the needle threads 60 and the looper thread 61 will be cut by the retracting lower knife sliding seat 21 and the upper knife sliding seat 22 remained in the first position. The looper thread 61 after being cut will be clamped and then released by actuating thread-releasing means 40 such that the looper thread 61 will be instantly sucked and clamped by the thread-sucking subassembly 50 for the next sewing operation.

It is to be understood that the above description and drawings are only used for illustrating one embodiment of the present invention, not intend to limit the scope of the present invention. Any variation and derivation from the above description and drawings should be included in the scope of the present invention.

BRIEF DESCRIPTION OF THE REFERENCE NUMERAL

| | | | |
|---|---|---|---|
| 10 | base plate | 11 | recess |
| 12 | fastening means | 120 | return spring |
| 13 | fastening means | 14 | fastening means |
| 140 | return spring | 1400 | spring base |
| 1401 | spring seat | 1402 | return spring |
| 17 | fastening means | 170 | regulating base |
| 171 | return spring | 20 | under trimming subassembly |
| 21 | lower knife sliding seat | 210 | lower knife |
| 211 | fastening means | 2100 | first hook section |
| 2101 | second hook section | 214 | convex corner |
| 22 | upper knife sliding seat | 220 | upper knife |
| 221 | clamping pieces | 222 | fastening means |
| 223 | lateral projection | 224 | concave corner |
| 225 | stopper | 30 | linkage |
| 31 | elongated slot | 32 | elongated slot |
| 33 | fastening means | 34 | through hole |
| 40 | thread-releasing means | 50 | thread-sucking subassembly |
| 51 | bottom plate | 510 | air passage |
| 511 | air passage | 5110 | neck portion |
| 52 | top plate | 53 | spring holder |
| 530 | slider | 531 | spring |
| 60 | needle thread | 61 | looper thread |
| 610 | free end | | |

| | | | | | |
|---|---|---|---|---|---|
| A | end portion | B | end portion | C | end portions |
| D | end portion | E | end portion | F | end portion |
| G | end portion | H | arrow | I | arrow |
| W | point | X | air port | Y | end |
| Z | end | | | | |

What is claimed is:

1. An under trimming device for a multi-needle sewing machine installed below a needle plate of said multi-needle sewing machine, comprising: a base plate 10 being formed with a recess 11 thereon and having at least a first fastening means 12, a second fastening means 13, a third fastening means 14, and a fourth fastening means 17 separately arranged thereon, said first fastening means 12 connects a first return spring 120, a second return spring 140 is provided between said third fastening means 14 and a spring base 1400, said spring base 1400 further includes a third return spring 1402 and a spring seat 1401, and a regulating base 170 is provided between said fourth fastening means 17 and said base plate 10 and can be controlled by a fourth return spring 171;

an under trimming subassembly 20 including a lower knife sliding seat 21 and [a]an upper knife sliding seat 22; said lower knife sliding seat 21 having a first end portion to which a lower knife 210 is connected, said lower knife 210 including a first hook section 2100 and a second hook section 2101; said upper knife sliding seat 22 having a first end portion on top of which an upper knife 220 is connected and to bottom of which clamping pieces 221 are provided; said lower and upper knife sliding seats 21, 22 being disposed parallelly in said recess 11 of said base plate 10 such that a second end portion of said lower knife sliding seat 21 and of said upper knife sliding seat 22 lie on said recess 11 side by side; said lower knife 210 being located between said upper knife 220 and said clamping pieces 221; said second end portion of said lower and upper knife sliding seats 21, 22 respectively having a fifth fastening means 211 and a sixth fastening means 222 threaded thereto; said upper knife sliding seat 22 having a lateral projection 223 formed near a middle portion thereof against which said second return spring 140 presses so that said upper knife sliding seat 22 and said upper knife 220 connected thereto always return to an original position after they are shifted; a stopper 225 being provided on said base plate 10 for positioning said lateral projection 223;

a linkage 30 being substantially an elongated plate fitted over said base plate 10 by said second fastening means 13 such that said linkage 30 is capable of swinging about said second fastening means 13 which functions as a pivot; a first end portion of said linkage 30 being formed with a first elongated slot 31 to receive said fifth fastening means 211 connected to said second end portion of said lower knife sliding seat 21 and allow said fifth fastening means 211 to project therefrom; a second end portion of said linkage being formed with a second elongated slot 32 adapted to connect a transmission mechanism of said sewing machine so that said linkage 30 can be driven by said transmission mechanism; and said linkage 30 further having a lateral middle projection with a through hole 34 formed therein and a seventh fastening means 33 provided adjacent thereto;

a thread-releasing means 40 being substantially an elongated S-shaped plate pivotally connected to said linkage 30 at said through hole 34 in said lateral middle projection of said linkage 30 such that said thread-releasing means 40 is capable of pivotally swinging about said through hole 34; a first end portion of said thread-releasing means 40 being pressed against by said first return spring 120 connected to said first fastening means 12 on said base plate 10 such that said thread-releasing means 40 always returns to an original position after being shifted; and a second end portion of said thread-releasing means 40 located within a shifting track of said sixth fastening means 222 connected to and upwardly projected from said second end portion of said upper knife sliding seat 22 and being capable of pushing said upper knife sliding seat 22 to move in a direction opposite to said first end portion of said upper knife sliding seat 22; and a thread-sucking subassembly 50 being provided at a lateral side of said under trimming subassembly 20 comprising a bottom plate 51 and a top plate 52 covered on said bottom plate 51, said bottom plate 51 having a first and a second air passages 510, 511 formed at an upper surface thereof, which are communicable at one end, said first and said second air passages 510, 511 having a common air port where a suction unit is connected, said second air passage 511 having a spring holder 53 disposed therein, said spring holder 53 consisting of a slider 530 and a fifth spring 531; and said fifth spring 531 having a first end pressing against a first end wall of said slider 530 and a second end pressing against a neck portion 5110 of said second air passage 511 having a reduced inner diameter near said air port.

* * * * *

UNITED STATES PATENT AND TRADEMARK OFFICE

CERTIFICATE OF CORRECTION

PATENT NO. : 5,415,119

DATED : May 16, 1995

INVENTOR(S) : Kenji Ikeda

It is certified that error appears in the above-identified patent and that said Letters Patent is hereby corrected as shown below:

On the title page:

In the Abstract, line 2, please delete "late" and insert in lieu thereof --plate--.

In column 1, line 10, please delete "solliding" and insert in lieu thereof --colliding--.

In column 1, line 14, please delete "Operation" and insert in lieu thereof --operation--.

In column 1, line 26, please delete "cue" and insert in lieu thereof --cut--.

In column 1, line 39, please delete "6" and insert in lieu thereof --61--.

In column 1, line 40, please delete "35" and insert in lieu thereof --25--.

In column 1, line 42, please delete "75288507;" and insert in lieu thereof --75288507:--.

In column 1, line 44, please delete "3" and insert in lieu thereof --13--.

In column 1, line 44, please delete "Crack" and insert in lieu thereof --track--.

In column 1, line 47, please delete "place" and insert in lieu thereof --plate--.

In column 1, line 49, please delete "place" and insert in lieu thereof --plate--.

In column 1, line 62, please delete "place" and insert in lieu thereof --plate--.

In column 1, line 64, please delete "shafting" and insert in lieu thereof --shifting--.

In column 2, line 16, please delete "resent" and insert in lieu thereof --present--.

In column 2, line 42, please delete "referred" and insert in lieu thereof --preferred--.

In column 3, line 7, please delete "end" and insert in lieu thereof --and--.

UNITED STATES PATENT AND TRADEMARK OFFICE

CERTIFICATE OF CORRECTION

PATENT NO. : 5,415,119

DATED : May 16, 1995

INVENTOR(S) : Kenji Ikeda

It is certified that error appears in the above-identified patent and that said Letters Patent is hereby corrected as shown below:

In column 3, line 25, please insert --21-- between the words "seat" and "has".

In column 3, line 30, please delete "20" and insert in lieu thereof --220--.

In column 3, line 34, please delete "=he" and insert in lieu thereof --the--.

In column 3, line 53, please delete "31" and insert in lieu thereof --21--.

In column 3, line 60, please delete "near" and insert in lieu thereof --near by--.

In column 4, line 13, please delete "a=one" and insert in lieu thereof --at one--.

In column 4, line 17. please delete "$31" and insert in lieu thereof --531--.

In column 4, line 25, please delete "Knife" and insert in lieu thereof --knife--.

In column 4, line 36, please delete "=he" and insert in lieu thereof --the--.

In column 4, line 36, please delete "2" and insert in lieu thereof --22--.

In column 4, line 43, please delete "1100" and insert in lieu thereof --2100--.

In column 4, line 44, please delete "Catch" and insert in lieu thereof --catch--.

In column 5, line 8, please delete "10" and insert in lieu thereof --510--.

In column 5, line 10, please delete "An" and insert in lieu thereof --in--.

In column 5, line 13, please delete "Cutting" and insert in lieu thereof --cutting--.

In column 5, line 19, please delete "11" and insert in lieu thereof --all--.

UNITED STATES PATENT AND TRADEMARK OFFICE

CERTIFICATE OF CORRECTION

PATENT NO. : 5,415,119

DATED : May 16, 1995

INVENTOR(S) : Kenji Ikeda

It is certified that error appears in the above-identified patent and that said Letters Patent is hereby corrected as shown below:

In column 5, line 22, please delete "31" and insert in lieu thereof --21--.

In column 6, line 18, please delete "[a]an" and insert in lieu thereof --an--.

In column 6, line 34, please insert --,-- between the words "respectively" and "having".

Signed and Sealed this

Third Day of October, 1995

Bruce Lehman

*Attest:*

BRUCE LEHMAN

*Attesting Officer*

*Commissioner of Patents and Trademarks*